US007216592B2

(12) United States Patent
Krech et al.

(10) Patent No.: US 7,216,592 B2
(45) Date of Patent: May 15, 2007

(54) PLASTIC SHIPPING AND STORAGE CONTAINERS AND COMPOSITION AND METHOD THEREFORE

(75) Inventors: John E. Krech, Eagan, MN (US); Paul D. Driscoll, Woodbury, MN (US); James R. Harrison, Oakdale, MN (US); Denis M. Miling, Maplewood, MN (US); Domasius Nwabunma, Woodbury, MN (US); Mario A. Perez, Burnsville, MN (US); Donald F. Reuter, Bloomington, MN (US)

(73) Assignee: 3m Innovative Properties Company, St. Paul, MN (US)

( * ) Notice: Subject to any disclaimer, the term of this patent is extended or adjusted under 35 U.S.C. 154(b) by 183 days.

(21) Appl. No.: 10/672,581

(22) Filed: Sep. 26, 2003

(65) Prior Publication Data

US 2004/0059035 A1 Mar. 25, 2004

Related U.S. Application Data

(62) Division of application No. 09/990,601, filed on Nov. 21, 2001.

(51) Int. Cl.

| | |
|---|---|
| ***B65D 19/18*** | (2006.01) |
| ***B65D 85/00*** | (2006.01) |
| ***C08L 23/00*** | (2006.01) |
| ***C08L 63/00*** | (2006.01) |

(52) U.S. Cl. ..... 108/901; 525/122; 525/529

(58) Field of Classification Search ..... None
See application file for complete search history.

(56) References Cited

U.S. PATENT DOCUMENTS

| | | | |
|---|---|---|---|
| 3,268,636 | A | 8/1966 | Angell, Jr. |
| 3,581,681 | A | 6/1971 | Newton et al. |
| 3,938,448 | A | 2/1976 | Nishitani et al. |
| 3,979,354 | A | 9/1976 | Dyckmann et al. |
| 4,051,787 | A | 10/1977 | Nishitani et al. |
| 4,311,489 | A | 1/1982 | Kressner |
| 4,316,419 | A | 2/1982 | Cupido |
| 4,375,265 | A | 3/1983 | van de Wetering et al. |
| 4,397,246 | A | 8/1983 | Ishida et al. |
| 4,427,476 | A | 1/1984 | Beck et al. |
| 4,428,306 | A | 1/1984 | Dresen et al. |
| 4,550,830 | A | 11/1985 | Shuert |
| 4,597,338 | A | 7/1986 | Kreeger |
| 4,604,441 | A | 8/1986 | Ueeda et al. |
| 4,652,275 | A | 3/1987 | Bloecher et al. |
| 4,655,360 | A | 4/1987 | Juhanson |
| 4,684,678 | A | 8/1987 | Schultz et al. |
| 4,799,939 | A | 1/1989 | Bloecher et al. |
| 4,843,976 | A | 7/1989 | Pigott et al. |
| 4,879,956 | A | 11/1989 | Shuert |
| 4,997,461 | A | 3/1991 | Markhoff-Matheny et al. |
| 5,011,508 | A | 4/1991 | Wald et al. |
| 5,039,311 | A | 8/1991 | Bloecher |
| 5,090,968 | A | 2/1992 | Pelllow |
| 5,131,926 | A | 7/1992 | Rostoker et al. |
| 5,152,917 | A | 10/1992 | Pieper et al. |
| 5,201,916 | A | 4/1993 | Berg et al. |
| 5,213,591 | A | 5/1993 | Celikkaya et al. |
| 5,474,583 | A | 12/1995 | Celikkaya et al. |
| 5,500,273 | A | 3/1996 | Holmes et al. |
| 5,585,407 | A | 12/1996 | Patel et al. |
| 5,638,760 | A | 6/1997 | Jordan et al. |
| 5,662,048 | A | 9/1997 | Kralj et al. |
| 5,709,948 | A | 1/1998 | Perez et al. |
| 5,744,504 | A | 4/1998 | Oishi et al. |
| 5,834,535 | A | 11/1998 | Abu-Isa et al. |
| 5,879,495 | A | 3/1999 | Evans |
| 5,897,930 | A | 4/1999 | Calhoun et al. |
| 5,969,053 | A | 10/1999 | Bauman et al. |
| 6,006,677 | A | 12/1999 | Apps et al. |
| 6,024,824 | A | 2/2000 | Krech |
| 6,148,291 | A | 11/2000 | Radican |
| 6,258,201 | B1 | 7/2001 | Krech |
| 6,294,114 | B1 | 9/2001 | Muirhead |
| 6,344,508 | B1 | 2/2002 | Endo et al. |
| 6,509,084 | B2 | 1/2003 | Sturtevant et al. |
| 6,596,893 | B2 | 7/2003 | Nakacho et al. |
| 6,661,339 | B2 | 12/2003 | Muirhead |
| 6,705,237 | B2 * | 3/2004 | Moore et al. ..... 108/57.25 |
| 6,718,888 | B2 | 4/2004 | Muirhead |

(Continued)

FOREIGN PATENT DOCUMENTS

| | | |
|---|---|---|
| DE | 199 49 851 | 4/2001 |

(Continued)

OTHER PUBLICATIONS

Machine translation of JP 07-331033, provided by the JPO website.*

*Primary Examiner*—Michael J. Feely
(74) *Attorney, Agent, or Firm*—Eloise J. Maki; Sean J. Edman

(57) ABSTRACT

A polymeric composition comprises a thermosetting resin and a polyolefin resin that cures to a semi-interpenetrating polymer network and is useful for producing plastic shipping and storage containers. The containers exhibit one or more friction surfaces, and can include fire resistance and other properties derived from property enhancing agents.

21 Claims, 1 Drawing Sheet

U.S. PATENT DOCUMENTS

| | | | | |
|---|---|---|---|---|
| 6,749,418 | B2 | 6/2004 | Muirhead | |
| 6,943,678 | B2 | 9/2005 | Muirhead | |
| 2001/0031807 | A1 | 10/2001 | Adedeji et al. | |
| 2002/0115789 | A1* | 8/2002 | Nodera et al. | 525/67 |
| 2004/0168618 | A1 | 9/2004 | Muirhead | |
| 2005/0237184 | A1 | 10/2005 | Muirhead | |
| 2005/0241548 | A1 | 11/2005 | Muirhead | |
| 2006/0243174 | A1 | 11/2006 | Muirhead | |

FOREIGN PATENT DOCUMENTS

| | | |
|---|---|---|
| DE | 100 10 072 | 9/2001 |
| EP | 0417912 | 3/1991 |
| GB | 2274832 | 8/1994 |
| JP | 6-298236 | 10/1994 |
| JP | 07-331033 | * 12/1995 |
| JP | 11-29184 | 2/1999 |
| JP | 11-278485 | 10/1999 |
| WO | WO 97/32805 | 9/1997 |
| WO | WO 00/05143 | 2/2000 |
| WO | WO 00/20495 | 4/2000 |
| WO | WO 00/64296 | 11/2000 |
| WO | WO 01/23462 | 4/2001 |

* cited by examiner

PLASTIC SHIPPING AND STORAGE CONTAINERS AND COMPOSITION AND METHOD THEREFORE

This application is a divisional of U.S. Ser. No. 09/990,601, filed Nov. 21, 2001, now pending, the disclosure of which is herein incorporated by reference.

FIELD OF THE INVENTION

This invention relates to plastic shipping and storage containers and to polymeric compositions and methods useful for producing them.

BACKGROUND ART

Plastic shipping and storage containers are widely used in national and international commerce. Containers protect and support their contents during storage and shipment and there is an increasing demand that containers be effective in helping to maintain the quality of their contents.

A particularly useful shipping and storage container is the pallet (a structural platform made of metal, wood, or plastic materials). Wooden pallets have been in use for a number of years but they tend to be heavy, bulky, and expensive to make and maintain. Additionally, they are subject to deterioration due to adverse weather and can fail due to rotting when wet. Additionally, wooden pallets are fastened together by means such as glue, nails, staples, etc. Inclement weather also accelerates deterioration of these fastening means.

The potential for infestations by insects has created increasing demand for treatment of wooden pallets prior to export. Since Oct. 1, 2001, for example, the European Union requires heat or chemical treatment for all coniferous non-manufactured wood packaging. Shipments that do not comply may be refused at the border; more likely, non-compliant packaging will be destroyed at the shipper's expense.

Metallic pallets also present problems. Typically, they are expensive, heavy and subject to corrosion.

Plastic pallets overcome many of the problems of wooden and metallic pallets, but they present problems of their own. During fires they are subject to flowing, which results in molten plastic spreading heat and fire. The National Fire Protection Association has passed stringent regulations that have diminished the utility of plastic pallets.

References disclosing plastic pallets are known. WO 00/20495 discloses high performance plastic pallets having a composition comprising a thermosetting resin, which can be an epoxy resin, as well as a plurality of thermoplastic resins. The composition can include, for example, flame retardants. No polyolefin is disclosed. U.S. Pat. No. 5,879,495 relates to constructions of polyvinyl chloride pallets. WO 00/05143 discloses plastic pallets having a polyolefin top deck and a polycarbonate or polyphenilin derivative bottom deck. JP 11278485 relates to polyolefin/halogenated epoxy compositions useful to make a pallet. The halogenated epoxy acts as a flame retardant, optionally in combination with a second flame retardant.

U.S. Pat. No. 4,428,306 discloses a thermoformed pallet constructed of a thermoplastic resin material. A film to create a laminated non-skid surface is provided.

U.S. Pat. No. 4,051,787 discloses a plastic pallet having a deckboard provided with a rubber anti-slip member or coating. U.S. Pat. No. 6,006,677 provides a synthetic resin pallet with a slip-resistant scuffed texture surface, created by brushing the surface with a cup-shaped wire brush.

Plastic pallets having a foamed structure have been disclosed. U.S. Pat. No. 3,581,681 relates to structural foamed pallets comprising a variety of components including polyolefin and epoxy. No additives are included in their compositions. U.S. Pat. No. 4,375,265 discloses a one piece molded pallet container comprising a foam composition comprising a variety of thermoplastic resins, for example, polyethylene, polyphenylene oxide, polyamide, and others. No epoxy resins are disclosed, nor are any additives. Thermoplastic thermoset hybrid foams have been disclosed in WO 01/23462 having use as flexographic mounting tapes. No molded articles are disclosed.

U.S. Pat. No. 5,709,948 discloses semi-interpenetrating polymer networks (semi-IPNs) of epoxy and polyolefin resins useful, for example, as tape backings, fibers, coatings, foamed constructions, and molded foamed parts.

SUMMARY OF THE INVENTION

Briefly, the present invention provides a plastic shipping and storage container comprising a composition of matter including (a) one or more of polyolefin resins and blends thereof, and (b) one or more of thermosetting resins; the plastic shipping and storage container further comprising an effective amount of friction material on at least one surface thereof.

The friction material useful in the present invention provides the protected surface of the container with a static coefficient of friction of dry or wet surfaces in the range of 0.60 to 1.20, preferably in the range of 0.75 to 1.00, and more preferably in the range of 0.80 to 1.00. For oily surfaces, a desirable container coefficient of friction is in the range of 0.30 to 1.00, preferably in the range of 0.40 to 1.00, and more preferably in the range 0.50 to 0.95. In some embodiments of the invention it may be desirable to provide the container with different coefficients of friction in different locations on the container. For example, it may be desirable to have the locations in contact with fork truck tines at lower levels of friction to avoid damage to the fork truck tines due to abrasion.

Optionally, the plastic container composition comprises one or more of radio frequency identification (RFID) tags, and property enhancement additives, such as flame retardants, antimicrobial agents, foaming agents, UV stabilizers, antioxidants, and fillers. The plastic shipping container preferably meets the requirements of Underwriters Laboratory (UL) 2335 protocol for pallets.

Preferably, the resins are free of halogen in the interest of environmental safety.

Preferably, the composition of matter comprises:

a) 1 to 49 parts by weight of a curable thermosetting resin, the parts being based on the total composition;

b) 51 to 99 parts by weight of at least one of a fully prepolymerized uncrosslinked hydrocarbon polyolefin resin and a fully prepolymerized uncrosslinked functionalized polyolefin resin, the weight percent being based on the total composition, wherein the hydrocarbon polyolefin is present in the range of 25 to 99 parts by weight of the total composition and the functionalized polyolefin is present in the range of 0 to 50 parts by weight of the total composition, and c) performance enhancement additives in the range of 0 to 70 parts by weight, preferably more than 0 to 70 parts by weight, of the total composition.

In a preferred embodiment, the present invention provides a plastic shipping or storage container comprising a composition including a semi-interpenetrating polymer network comprising a thermally cured epoxy resin, a fully pre-polymerized hydrocarbon polyolefin homopolymer or copolymer, and optionally, a fully pre-polymerized functionalized polyolefin resin. More preferably, the plastic container comprises an effective amount of at least one of a surface friction material and a flame retardant.

The present invention provides a method for producing a plastic container comprising the steps:

a) admixing a composition comprising
   (1) one or more thermosetting resins and curing agent therefor,
   (2) a fully pre-polymerized uncrosslinked hydrocarbon polyolefin resin, and optionally a fully pre-polymerized uncrosslinked functionalized polyolefin, and
b) exposing said composition to curing conditions after forming the composition into a useful article.

In another aspect, the present invention comprises a curable polymeric composition comprising a) a polyolefin resin or blends thereof,
b) a thermosetting resin, and
c) an effective amount of a flame retardant.

Curing can be accomplished by exposure to curing conditions such as by exposure to heat or irradiation by light until the composition is formed in place, molded, coated, or otherwise prepared in a useful format.

In another aspect, the present invention describes a method of preparing a shaped article or sheet article comprising a semi-interpenetrating polymer network comprising the steps of (a) intimately mixing a composition comprising a fully pre-polymerized hydrocarbon thermoplastic polyolefin resin or copolymer thereof, optionally, a fully pre-polymerized polyolefin resin comprising polar functionality; a curable thermosetting resin, and at least one curing agent for the thermosetting resins; (b) forming the composition into a shaped article or a sheet article; (c) laminating or bonding friction material onto or within a surface of the shaped article or sheet article; and (d) at the appropriate time, activating the curing agent by supplying sufficient energy to the composition. Lamination is preferably free of added adhesive. The thermosetting resin and the curing agent can be added together or in separate steps. The lamination can take place in process, preferably in in-mold lamination, or it can take place after shaping the article or sheet.

The thermosetting resin curing agent can be thermally curable or photocurable. A high temperature stable thermal curing agent or a photocatalyst can be added to the curable admixture. Activation of the curing agent can be immediate or delayed.

In a preferred embodiment, the shipping container is a plastic pallet that has an open deck design, and on at least one surface thereof it comprises a friction or anti-slip material that has been in-mold laminated. In another preferred embodiment, the container composition comprises at least two resins and optionally includes one or more of (a) a flame retardant, (b) an antimicrobial additive, an antimicrobial coating, and/or antimicrobial granules, and (c) other performance enhancing additives. In a more preferred embodiment, the cured composition can be microcellular foamed. What has not been described in the art is how these have been synergistically combined.

It is advantageous in the art for plastic shipping containers and their precursor compositions to have one or more of the following characteristics: increased fire resistance (including such as meeting the Underwriters Laboratories (UL) 2335 protocol for pallets), increased coefficient of friction to reduce slippage and damage, increased surface energy for improved bonding, improved control of thermal expansion and thermal deflection, improved pathogenic performance, improved chemical resistance for industrial applications, improved resistance to UV and oxidative degradation, and improved processing ease due to reduced viscosity, pressure, temperatures, and equipment size. The present inventive plastic containers can exhibit these desirable characteristics.

In this application:

"hydrocarbon polyolefin" means a fully pre-polymerized uncrosslinked polymeric hydrocarbon bearing essentially no organic functional groups, prepared from homopolymerization and/or copolymerization of an olefinic monomer(s);

"friction surface" means a surface, in whole or in part, which comprises a friction material laminated or bonded therein or thereon;

"friction" and "anti-slip" have the same meaning;

"functionalized polyolefin" means a fully pre-polymerized uncrosslinked polymeric hydrocarbon bearing polar organic functional groups;

"filler" means a dispersed particle, fiber, flake, or the like;

"in-mold lamination" means placed in a mold and becomes laminated to subsequently added resin without added adhesive;

"mildewcide" means an antifungal agent;

"plastic" means a material comprised substantially of an organic polymer; and

"semi-interpenetrating polymer networks (semi-IPNs)" means polymer networks of two or more polymers wherein at least one polymer is crosslinked and at least one polymer is uncrosslinked.

Contamination of foodstuffs by bacteria, viruses and parasites has recently become of growing concern, because the resulting infections living beings often are refractory to drug treatment. However, a need exists for an antimicrobial composition that will simultaneously inhibit the growth of fungi, viruses, actinomycetes and parasites, as well as bacteria.

The present invention provides for the reduction of microbial contamination of plastic shipping containers, including but not limited to containers useful for the processing and storage of foodstuffs. In general terms, the present invention relates to the incorporation of antimicrobial agents into polymeric materials, such that the activity of the agents will reduce the microbial contamination of the plastic container. In a preferred embodiment, antimicrobial agents are mixed with polymer compositions during formation of the plastic molded containers and thereafter serves to reduce or destroy the bacteria on that portion of the foodstuffs with which it comes into contact. Another embodiment of the invention provides antimicrobial protection that allows for controlled migration of an anti-microbial agent throughout a polymer. The invention can also provide a container having an antimicrobial agent that is substantially insoluble in water, thereby preventing any significant leaching of the agent during use of the container.

It is believed not known in the art to use antimicrobial materials in conventional plastic shipping containers. Furthermore, the prior art is generally deficient in affording a composition that will not only control bacterial growth, but will also simultaneously control the growth of fungi, viruses, and parasites.

Plastic pallets in general are capital and labor intensive to manufacture. The temperatures, viscosities, and pressures involved in their manufacture are generally very high and require significant capital outlay. In the present invention, the addition of the uncured thermosetting resin advantageously reduces viscosity and hence creates the ability to reduce processing temperatures such that flame retardant, antimicrobial, and blowing agent additives can be added without loss of additive effectiveness. Not only is the ability to add these important properties enhanced but the ability to improve productivity and reduce equipment size is also achieved.

Chemical and physical foaming of thermoplastic materials has been practiced for a number of years. Physical methods that use carbon dioxide as a foaming agent comprise one of the new and most promising trends for the continuous manufacture of foamed goods. In this invention use of carbon dioxide is preferred as a blowing agent to aid in the simultaneous incorporation and foaming of an uncured thermosetting resin into a thermoplastic resin. This invention also teaches the use of chemical means to foam some thermoplastic resins that contain a thermosetting monomer. Polymeric foams include a plurality of voids, also called cells, in a polymer matrix. By replacing solid plastic with voids, polymeric foams use less raw material than solid plastics for a given volume.

Improvements in properties are realized through cure of the thermoset. This can be done during or after the foam has been formed. Reinforcing properties such as flexural modulus, impact strength, tensile strength, and compressive strength are obtained by means of the foam, as are increased monomer miscibility in the matrix, cell formation and enhanced surface compatibility. For example, improvement in compressive strength of the cured material over that of a control or its plasticized uncured version has been obtained as described in WO 0123462.

The present invention, by providing compositions of increased surface energy, overcomes the problem of tracking plastic pallets on an individual basis. The low surface energy of many polymeric materials requires specials adhesives for labels and tags that still can be too easily removed during use and cleaning. Methods to conveniently insert tags and protect tags are not adequately described in the art.

The present invention discloses a plastic shipping container comprising a curable composition including a curable thermosetting resin, i.e., preferably an epoxy resin, an unmodified fully pre-polymerized hydrocarbon polyolefin resin, and optionally a fully pre-polymerized functionalized polyolefin, wherein the curable epoxy resin preferably is not exposed to curing conditions (i.e., temperatures greater than about 200 degree C. or irradiation by light) until the composition is formed in place, molded, coated, or otherwise prepared in a useful format.

DETAILED DESCRIPTION OF PREFERRED EMBODIMENTS

Figure 1:
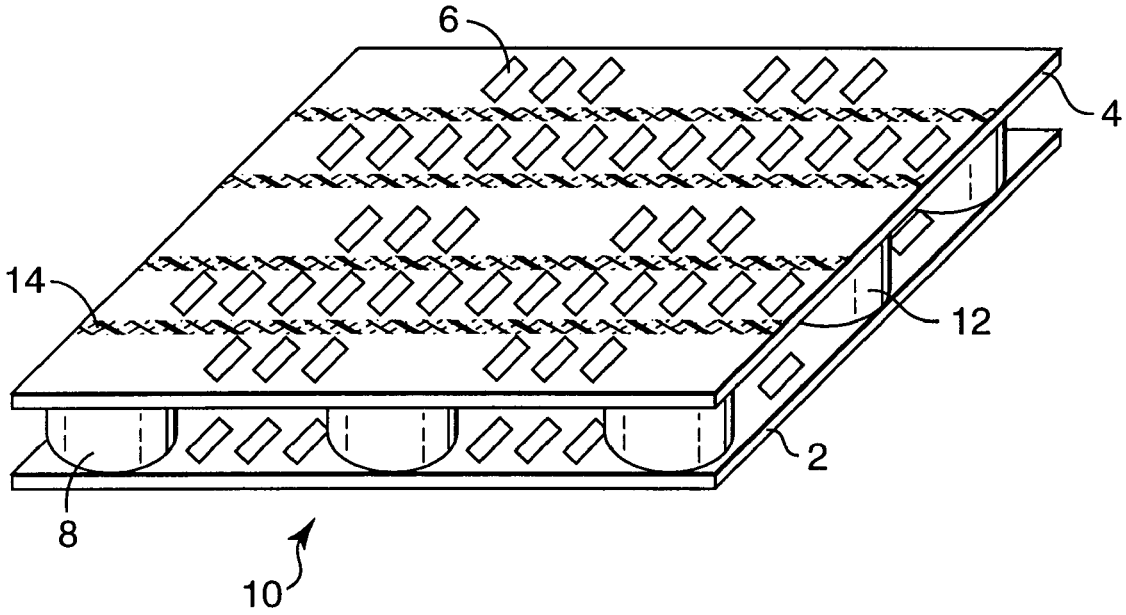
FIG. 1 shows a pallet of the invention having an open deck design and friction material on its upper surface.

The present invention provides a curable composition comprising:

a) 1 to 49 part by weight, preferably 1 to 30, most preferably 5 to 15 parts by weight, of a curable thermosetting resin, the parts by weight being based on the total composition;

b) an effective amount of a curative for the curable thermosetting resin; and c) 51 to 99 parts by weight of at least one of a fully prepolymerized uncrosslinked hydrocarbon polyolefin resin and a fully prepolymerized uncrosslinked functionalized polyolefin resin, the weight percent being based on the total composition, wherein said hydrocarbon polyolefin is present in the range of 25 to 99 parts by weight of the total composition and said functionalized polyolefin is present in the range of 0 to 50 parts by weight of the total composition.

Preferably, blending of the components takes place at a temperature that is below the thermal activation temperature of the catalyst. Preferably, the functionalized polar group comprises at least one O, N, S, or P atom.

As noted above, the inclusion of thermosetting resins in a fully pre-polymerized hydrocarbon polyolefin continuous phase provides the polyolefin with a number of advantageous properties. Thermosetting resins include epoxy, curable polyolefins including ethylene propylene diene monomer (EPDM), ethylene propylene rubber (EPR), ethylene butylene rubber (EBR), phenolics, polyurethanes, unsaturated polyesters, furan, allyls, vinyls, silicones, alkyds, and nitrile rubber including carboxyl terminated butadiene nitrile rubber (CTBN), amine terminated butadiene nitrile rubber (ATBN), hydroxyl terminated butadiene nitrile rubber (HTBN), and epoxy terminated butadiene nitrile rubber (ETBN).

Epoxy resins are characterized by the presence of a three membered ring known as the epoxy, epoxide, oxirane or ethoxyline group. Commercial epoxy resins contain aliphatic, cycloaliphatic, or aromatic backbones. The most widely used ones are epichlorohydrin and bisphenol-A derived resins. The outstanding performance characteristics of these resins are conveyed by the bisphenol-A (toughness, rigidity, and elevated temperature performance), the ether linkages (chemical resistance), and the hydroxyl and epoxy groups (adhesive properties and formulation latitude, or reactivity with a wide variety of chemical curing agents).

Curable monomeric epoxy resins serve to decrease the melt viscosity of the polyolefins, imparting improved handling and processing. Lowered processing temperatures also allows the inclusion of heat-sensitive performance enhancing additives, such as certain flame-retardants and antimicrobial agents, not otherwise usable in high-melting polyolefins. Low-molecular weight epoxy resins improve adhesion of the semi-IPNs to various substrates, in part because such low-molecular weight species can quickly migrate to the resin-substrate interface for improved bonding, perhaps through improved wetting or reaction of the epoxy functionality with functional groups on the substrate surface. These semi-IPN's have been disclosed in U.S. Pat. No. 5,709,948 which is incorporated herein by reference.

The thermosettable epoxy resins of the invention preferably comprise compounds which contain one or more 1,2-, 1,3- and 1,4-cyclic ethers, which also may be known as 1,2-, 1,3- and 1,4-epoxides. The 1,2-cyclic ethers are preferred. Such compounds can be saturated or unsaturated, aliphatic, alicyclic, aromatic or heterocyclic, or can comprise combinations thereof. Compounds that contain more than one epoxy group (i.e., polyepoxides) are preferred.

A wide variety of commercial epoxy resins are available and are listed or described in, e.g., the Handbook of Epoxy Resins, by Lee and Neville, McGraw-Hill Book Co., New York (1967), Epoxy Resins, Chemistry and Technology, Second Edition, C. May, ed., Marcell Decker, Inc., New York (1988), and Epoxy Resin Technology, P. F. Bruins, ed., Interscience Publishers, New York, (1968). Any of the epoxy resins described therein may be useful in preparation of the semi-IPNs of the invention.

It is within the scope of the present invention to include, as a bireactive comonomer, compounds having both epoxy functionality and at least one other chemical functionality, such as, e.g., hydroxyl, acrylate, ethylenic unsaturation, carboxylic acid, carboxylic acid ester, and the like. An example of such a monomer is Ebecryl™ 3605, commercially available from UCB Radcure, Inc., Atlanta, Ga., a bisphenol-A-type monomer having both epoxy and acrylate functionality.

Curatives of the present invention can be thermal curing agents or photocatalysts.

Certain thermally-activated curing agents for epoxy resins (e.g., compounds that effect curing and crosslinking of the epoxide by entering into a chemical reaction therewith) are useful in the present invention. Preferably, such curing agents are thermally stable at temperatures at which mixing of the components takes place.

Suitable thermal curing agents include aliphatic and aromatic primary and secondary amines, e.g., di(4-aminophenyl)sulfone, di(4-aminophenyl)ether, and 2,2-bis-(4-aminophenyl)propane; aliphatic and aromatic tertiary amines, e.g., dimethylamino-propylamine and pyridine; fluorene diamines, such as those described in U.S. Pat. No. 4,684,678, incorporated herein by reference; boron trifluoride complexes such as $BF_3Et_2O$ and $BF_3H_2NC_2H_4OH$: imidazoles, such as methylimidazole; hydrazines, such as adipohydrazine; and guanidines, such as tetramethylguanidine and dicyandiamide (cyanoguanidine, also commonly known as DiCy™ Air Products, Allentown, Pa.). It is to be understood that a careful choice among these curing agents must be made, since many of them would be unsuitable for use when high-melting polyolefin components are present, but they can be useful in preparing semi-IPNs of the invention that comprise low-melting polyolefins and epoxy resins.

Thermal curatives can be present in an amount such that the ratio of epoxy equivalents to thermal curative equivalents is in the range of 0.9:1 to 2:1.

Catalysts of the present invention (also known as "initiators," the terms being used interchangeably in the present invention) can also be activated by photochemical means. Known photocatalysts are of two general types: free radical and cationicPhotoinitiators useful in the invention can be present in an amount in the range of 0.01 to 10 parts by weight, preferably 0.01 to 5, most preferably 0.1 to 2 parts by weight based on total resin composition.

The uncrosslinked prepolymerized polyolefin resin can be homopolymers, copolymers, blends with other polyolefins, blends with high impact polymers such as polyphenylene oxide, polyphenylene ether, polycarbonate, high impact polystyrene polyethersulfone, polyetherimides or blends with rubbers/elastomers such as ethylene propylene diene monomer, ethylene propylene rubber, ethylene butylene rubber, polybutadiene, acrylonitrile butadiene styrene, styrene butadiene styrene, styrene ethylene butylene styrene, polyisoprene, polybutylacrylate, polyurethane.

More particularly, homopolymeric polyolefins useful in the invention include polyethylene, polypropylene, poly-1-butene, poly-1-pentene, poly-1-hexene, poly-1-octene and related polyolefins. Preferred homopolymeric polyolefins include polyethylene (e.g., Dow HDPE™, available from Dow Chemical Co., Midland, Mich.) and polypropylene (e.g., Shell DS5D45™, available from Shell Chemicals, Houston, Tex., or ExxonMobil Escorene™ 3445 and 3505G, available from Exxon Chemicals, Houston, Tex.). Also useful are copolymers of these alpha-olefins, including poly (ethylene-co-propylene) (e.g., SRD7™-462, SRD7-463 and DS7C50™, each of which is available from Shell Chemicals), poly(propylene-co-1-butene) (e.g., SRD6™-328, also available from Shell Chemicals), and related copolymers. Preferred copolymers are poly(ethylene-co-propylene). Also useful is the Vestoplast™ series of polyolefins, available from Huls America Inc., Piscataway, N.J.

The semi-IPNs of the invention also comprise functionalized polyolefins, i.e., polyolefins that have additional chemical functionality, obtained through either copolymerization of an olefin monomer with a functional monomer or graft copolymerization subsequent to olefin polymerization. Typically, such functionalized groups include O, N, S, or P. Such reactive functionalized groups include carboxylic acid, hydroxyl, amide, nitrile, or carboxylic acid anhydride. Many functionalized polyolefins are available commercially. For example, copolymerized materials include ethylene-vinyl acetate copolymers, such as the Elvax™ series, commercially available from DuPont Chemicals, Wilmington, Del., the Elvamide™ series of ethylene-polyamide copolymers, also available from DuPont, and Abcite™ 1060WH, a polyethylene-based copolymer comprising approximately 10% by weight of carboxylic acid functional groups, commercially available from Union Carbide Corp., Danbury, Conn. Examples of graft-copolymerized functionalized polyolefins include maleic anhydride-grafted polypropylene, such as the Epolene™ series of waxes commercially available from Eastman Chemical Co., Kingsport, Tenn. and Questron™, commercially available from Himont U.S.A., Inc., Wilmington, Del.

The present invention provides a process for producing a foam, including a microcellular foam, that includes a midlevel amount of a blowing agent. The microcellular foams can be produced in typical polymer processing techniques such as extrusion, injection molding and blow molding. The foams exhibit excellent mechanical properties and can be formed over a broad range of densities into a number of different foam plastic shipping containers. This process is described in PCT Patent document No. WO 0123462, which is incorporated herein by reference.

Structural foam as a plastic product has an integral skin and cellular core. The combination of the skin, which is normally solid, that is, without voids or cells, and cellular core, produces a relatively high strength to weight ratio. When structural foam is in the form of a pallet, it typically has rigidity for holding and transporting a load.

U.S. Pat No. 3,268,636 and WO 0123462 discloses the basic process for making structural foam articles by melting thermoplastic resin and forcing it into a mold in the presence of blowing agent to mold the article. Upon entry of the molten resin into the mold, the blowing agent foams the resin to create the cellular core of the molded article. The mold is kept at a temperature below the softening or melting temperature of the resins so that the resultant rapid solidification of the resin coming in contact with the surface of the mold surface remains sufficiently fluid in the mold to permit its foaming by the blowing agent. Thermoplastic/thermoset hybrid foams are described in patent document WO 0123462. Foams were prepared using a blowing agent that was used as a swelling agent and plasticizer for a thermoplastic polymer matrix and as a solvent that allows thermosettable material to be introduced into the thermoplastic matrix.

Any of a wide variety of physical and chemical blowing agents known to those of ordinary skill in the art such as hydrocarbons, chlorofluorocarbons, nitrogen, carbon dioxide, and the like can be used in connection with this embodiment of the invention. Blowing agents that are in the supercritical fluid state in an extruder are especially preferred, in particular supercritical carbon dioxide and supercritical nitrogen. These are disclosed in PCT Patent Doc. WO 0123462, which is incorporated herein by reference.

Microcellular foams have smaller cell sizes and higher cell densities than conventional polymeric foams. Typically, microcellular foams are defined as having average cell sizes of less than 100 micrometers and a cell density of greater than $10^6$ cells/$cm^3$ of solid plastic. In a typical continuous process for forming microcellular foam (e.g. extrusion), the pressure on a single-phase solution of blowing agent and polymer is rapidly dropped to nucleate the cells.

It should be understood that the above described formulation and process is not limiting. Modifications, well-known in the art, can be made to the formulation and process in various embodiments of the invention.

Various adjuvants can also be added to the compositions of the invention to alter the physical characteristics of the cured semi-IPN. Included among useful adjuvants are thixotropic agents such as fumed silica; colorants and pigments to enhance color tones such as ferric oxide, carbon black and titanium dioxide; fillers such as mica, silica, acicular wollastonite, calcium carbonate, magnesium sulfate and calcium sulfate; clays such as bentonite; glass beads and bubbles, reinforcing materials such as unidirectional woven and nonwoven webs of organic and inorganic fibers such as polyester, polyimide, glass fibers, polyamides such as poly (p-phenylene terephthalamide), carbon fibers, and ceramic fibers, UV stabilizers, antioxidants, and mildewcides. Amounts up to about 200 parts of adjuvant per 100 parts of polyolefin-epoxy composition can be used.

More particularly, we have found it desirable to use certain ammonium polyphosphates as a flame retardant agent for semi-IPN resins of the compositions of the present invention. Also suitable as flame-retardant additives for this invention are compounds containing phosphorus-nitrogen bonds, such as phosphonitrilic chloride, phosphorus ester amides, phosphoric acid amides, tris(aziridinyl) phosphine oxide, cyclic phosphates, or tetrakis(hydroxymethyl) phosphonium chloride. These flame-retardant additives are commercially available and in the preferred embodiment are non-halogenated.

The semi-IPNs of the present invention synergistically provide the ability to add flame retardants since many flame retardants cannot exceed 204° C. without activation. Process temperatures in the art may be as high 260° C. or more. The reduction in viscosity allows for reduced processing temperatures which in turns allows flame retardant additives to be incorporated. Semi-IPN formulations improve the fire resistance such that less flame retardant additives are required. This prevents the loss in properties and the added costs of expensive raw materials.

The flame retardant can be present in at least the minimum amount necessary to impart a degree of flame retardancy to the composition to comply with the requirements of the UL 2335 protocol for pallets. The particular amount will vary, depending on the molecular weight of the organic phosphate, the amount of the flammable resin present and possibly other normally flammable ingredients, which may also be included in the composition.

Preferably performance enhancement additives can be included in an amount of 0 to 70 parts by weight of the total composition. Most preferably, flame retardants can be added in an amount of 0–25 parts by weight, fillers (particulate and fibrous) 0–20 parts by weight, foaming or blowing agents (chemical and physical) 0–5 parts by weight, and others (colorants, UV stabilizers, etc.) 0–5 parts by weight, all based on 100 parts by weight of total composition. Fillers in polymeric foams are typically added in amounts of at least 20 parts by weight polymeric material, and in many cases greater than 30 parts by weight, based on the total composition, to reinforce the polymeric foam.

Thermal and photochemical curing of the epoxy component can occur before and/or after fabrication of the container. Prior to fabrication of the container, curing can take place in the extruder during compounding of epoxy with polyolefin and additives or during the injection molding process to make the container. Photochemical curing requires pre-irradiation of the mixture with radiation such as UV or visible light. Compounding and molding conditions should be chosen such that significant curing does not take place prior to fabrication of the container as this will pose processing and equipment cleaning problems. Curing of epoxy after fabrication of the container can take place at a constant temperature in an oven or autoclave. The post-fabrication cure temperature should be chosen such that a high degree of cure is obtained while maintaining the shape of the container. Also, a sufficient cure time should be provided. For thick containers, thermal curing is preferred to photocuring during the post-fabrication curing stage.

Plastic shipping containers, including pallets, of the present invention can be of a variety of shapes and constructions, as is known in the art. Any of the constructions and conventional plastic shaping processes known in the art (for example, U.S. Pat. Nos. 4,597,338, 6,006,677, 3,938,448, 4,316,419, 4,879,956, 4,843,976, 4,550,830, 4,427,476, and 4,428,306) can be used with the formulations, materials, and innovations of this invention. The containers of the present invention can be produced by a variety of melt processing techniques such as injection molding, thermoforming, extrusion, co-extrusion, and the like. They can be produced in a single piece or in a plurality of pieces that can be snapped, fused, or otherwise secured together.

A typical design for a plastic shipping container of the present invention is shown in FIG. 1 wherein plastic pallet 10 has an open deck design in accordance with a preferred embodiment and comprises two separately molded horizontal members including upper deck 4 and lower deck 2. Preferably, the container comprises a semi-IPN formulation and meets the requirements of UL 2335. Also, included in the invention are pallets having closed deck designs.

Upper and lower decks (4 and 2) have solid surfaces that are interrupted by a series of holes 6 of any suitable size or dimension, and that reduce the weight of the decks and allow for drainage in the event the pallet becomes wet.

Four corner supports 8 project upwardly from lower deck 2 at the corners thereof. Four medial supports 12 project upwardly from lower deck 2. A central support (not shown) projects upwardly from the center of lower deck 2. Each support preferably is hollow.

Synthetic resins used to form the pallet can have a rather slippery finish when the pallet is new. This is undesirable in certain areas, viz., the top of the upper deck 4, the underside of the lower deck 2, and the underside of the upper deck 4 in the regions between the supports, which can rest on the forks of a forklift.

In accordance with the invention, any of the surfaces of the pallet can be provided with friction material, which comprises, for example, insert-molding strips of surface friction materials 14, preferably a thermoplastic polymer (although a thermosetting polymer may also be used) such as an ionically crosslinked ethylene/methacrylic acid copolymer (e.g., Surlyn™, available from DuPont, Wilmington, Del.) having quartz, ceramic, or other mineral particles partially embedded or exposed in or on the polymer surface. The friction material can comprise an inorganic or organic anti-slip agent that provides the protected surface of the container with a static coefficient of friction in the range of 0.60 to 1.20, e.g., inorganic materials including inorganic oxides such as silica or alumina, ceramic, or other mineral particles, as well as organic materials such as abrasive polymeric beads, all of which can be in-mold laminated, or which can be applied or adhered uniformly, or in a patterned or random fashion. Preferably, anti-slip agent particles are rubber-free, because the coefficient of friction of rubber tends to drop in the presence of oils and moisture, and as the rubber hardens (from aging and low temperatures). The polymer of the friction material preferably has a composition different from that of the pallet or container.

Friction inserts can be, for example, friction particles or fibers incorporated in or on a polymeric surfaces, microreplicated or embossed polymeric surfaces, particles or fibers impregnated in a web, and the like. Friction inserts overcome slippage problems by controlling the surface coefficient of friction of plastic shipping containers. One of the major roadblocks to use of plastic pallets and other shipping containers is their low coefficient of friction. It is known that loads can fall off pallets, pallets can fall off fork trucks, and stacks of pallets can topple over. Temperature, moisture, durability requirements, and the need for recyclability have hindered efforts to completely resolve these issues. This invention provides the ability to include designed frictional surfaces for the containers involved, in the locations of concern on the containers; it provides the ability to recycle the containers, and it provides the ability to incorporate the friction material into the manufacture of the plastic container itself. Additives to the friction insert can include granules that contain antimicrobial properties.

Compatibility of materials and process as well as recyclability in constructions is required. The friction surface desirably resists melting and losing its coefficient of friction during processing. Melting can be sufficient to promote bonding yet not envelop exposed textured surfaces of friction material. The semi-IPN container formulations synergistically provide reduced pressures and temperatures to minimize the loss of friction. The friction surface desirably is compatible with the plastic container so that it can be bonded to or preferably in-mold laminated to the container and recycled with the container. The semi-IPN formulations synergistically provide better bondability through increased surface energy. The semi-IPN formulations synergistically bond the recyclable friction materials into the containers resin composite matrix without added adhesive. The friction surface desirably does not damage tooling. In a preferred embodiment, the particles can be rounded granules that are less abrasive (such as washed sand). The friction particles or granules preferably have a shape and hardness that minimizes damage to tooling and they can be readily removed by filtration during recycling. In another preferred embodiment, the friction surface can be covered prior to insert molding to protect tooling. The cover methods include but are not limited to masking tape, aluminum foil tapes, foam tapes, and water soluble coatings. Useful friction particles have an average size of about 5 to 6550 micrometers or more (corresponding to American National Standards Institute (ANSI) Grade mesh of about 900 to 3), preferably 50 to 5000 micrometers, more preferably 100 to 500 micrometers. Examples of useful friction particles include fused aluminum oxide (including fused alumina-zirconia), ceramic aluminum oxide, aluminum oxide, silicon carbide (including green silicon carbide), silicon oxide, garnet, diamond, cubic boron nitride, boron carbide, chromia, ceria, coal slag, quartz, ceramic spheres, and combinations thereof. Examples of particles that not only provide friction but also provide reflectivity are glass and ceramic particles such as beads and bubbles. Particles of this type having a diameter of about 30 to 850 micrometer are particularly useful. To produce a conductive material, metal, carbon black, graphite particles, or the like can be incorporated and used for antistatic or static dissipative properties.

Thermoplastic and thermoset particles, for example polyester and nylon, and melamine formaldehyde and phenol formaldehyde, may also be used as the friction particles, but care should be taken to avoid processing conditions such as high temperatures that would melt or degrade these particles. These polymeric particles can include fillers such as graphite or carbon black or any other fillers.

The friction particles used in the present invention can be irregular or precisely shaped. Irregularly shaped particles are made, for example, by crushing the precursor material. Examples of shaped particles include rods (having any suitable cross-sectional area), pyramids, and thin faced particles having polygonal faces. Shaped particles and methods of making them are described, for example, in U.S. Pat. Nos. 5,090,968 and 5,201,916, both of which are incorporated herein by reference for their teaching of shaped abrasive particles. Spherical glass or polymeric beads can be useful friction particles and have been used for pavement marking applications. Polymeric particles can be any shape either irregular or shaped (for example, cubes, spheres, discs, etc.).

The friction particles used in the present invention may be in the form of an agglomerate, i.e., multiple particles bonded together to form an agglomerate. Useful abrasive agglomerates are further described in U.S. Pat. Nos. 4,311,489, 4,652,275, 4,799,939, 5,039,311, and 5,500,273, all of which are incorporated herein by reference.

It is also contemplated to have a surface coating on the friction particles. Surface coatings may be used to increase the adhesion of the polymer of the friction material to the particle, alter the friction characteristics of the particles, or for other purposes. Examples of useful surface coatings on abrasive particles are taught, for example, in U.S. Pat Nos. 4,997,461, 5,011,508, 5,131,926, 5,213,591, and 5,474,583, all incorporated herein by reference. Coupling agents such as silanes, titanates, and zirconates are common coatings used on particles to increase their adhesion to organic materials and are useful in the present invention. A particularly useful coupling agent is 3-aminopropyltrimethoxysilane (Union Carbide Corp., Danbury, Conn., under the trade designation "A-1100" brand silane).

This invention provides a cost effective method for imbedding friction surfaces into plastic containers in order to provide a designed frictional and/or protective surface. In a preferred embodiment the friction material can comprise a film or substrate that includes friction particles impregnated in a polymer similar to that of the plastic container such that the friction material can be subsequently thermally bonded to the plastic container. The particles protrude from the surface so as to provide the desired friction properties thereto. The particle impregnated substrate can be formed or produced by numerous methods including those described in U.S. Pat. Nos. 6,024,824 and 5,152,917, which are incorporated herein by reference.

Other suitable friction materials include particle impregnated webs disclosed in U.S. Pat. Nos. 6,024,824 and 6,258,201, microreplicated webs disclosed in U.S. Pat. Nos. 5,897,930 and 5,152,917 and PCT publication WO 0064296, all of which are incorporated herein by reference.

Alternatively, the friction surface can consist of cured microreplicated surfaces as outlined in WO 0064296. However, the friction material preferably is different in composition from the plastic container. The plastic container with the friction material embedded or attached to desired surfaces can be formed or produced by numerous methods including in-mold laminate injection molding, compression molding, blow molding, heat staking, and thermal forming.

In a preferred embodiment of the invention an anti-slip film or tape can be laminated to a plastic pallet. The pallet preferably is made of polyolefin because it is inexpensive. Polyolefins, however, are normally difficult to attach things to because of their low surface energy. The present invention polyolefin-containing polymer blends provide improved adhesion (because of increased surface energy), improved processability through lower viscosity than the base polyolefin alone, and inherent flame retardance. Preferably the polymer of the friction material is chosen such that is has a composition that is amenable to sticking well to the polymer of the pallet (for example, the film can be made of SURLYN™), therefore not requiring the addition of an adhesive on its back side to achieve lamination. Such adhesive-free lamination is also called "in-mold" lamination. The film composition is also chosen so that it effectively retains anti-slip particles without allowing them to become either detached or buried when the film is made, during in-mold lamination, or during pallet use. Polymers useful in the friction material include, but are not limited to either a thermoplastic, thermoplastic elastomer, thermosetting material, or combinations of those. If combined, it is preferred that the mixture be homogenous. However, in some instances it may be preferred that the-polymeric sheet comprising the friction material have areas of different material, depending on the desired properties. Preferably, the polymeric sheet is either a thermoplastic or thermoplastic elastomer. Suitable thermoplastic materials include polyethylene, polyesters, polystyrenes, polycarbonates, polypropylene, polyamides, polyurethanes, polyvinyl chloride, nylons, poly alpha olefins, functionalized olefins, and combinations thereof. Particularly useful thermoplastic polymeric materials include SURLYN™, an ionically crosslinked ethylene/methacrylic acid copolymer, NUCREL™, an ethylene acid copolymer (both available from DuPont, Wilmington, Del.), and polypropylene (available for example as 3365™ from Fina Inc., Dallas, Tex.). Examples of suitable thermoset materials include phenolic resins, rubbers, acrylates, vinyl esters, unsaturated polyesters, and epoxies.

The friction surfaces preferably are not treated with an antimicrobial agent prior to molding the pallet. Alternatively the friction surface can be laminated to an antimicrobial film or an antimicrobial agent can be incorportated throughout the pallet body. The antimicrobial additive chosen preferably is essentially insoluble in water to prevent any leaching of the compound during use. In use, the antimicrobial agent migrates through the polymer material to the exposed surface thereof from the amorphous zones of the polymer until equilibrium of the internal vapor pressure is reached. If the antimicrobial substance on the surface of the pallet or the friction surface is removed by friction, or other means, antimicrobial agent moves to the surface until the agent's internal vapor pressure is once again at equilibrium.

Antimicrobials such as mildewcides, antiseptics, disinfectants, sanitizers, germicides, algaecides, slimicides, antifouling agent, or preservatives are typically employed to remove microbes from an area and prevent their recurrence. The use of antimicrobials in the control or prevention of microbial growth requires effective contact between the antimicrobial agent and the microbe. One problem in achieving effective and long lasting control of microbial growth has been the ease by which commercially available antimicrobial compositions can be washed from most substrates by the application of moderate volumes of water. In moist environments such as a food preparation, for example, the pallets often experience daily exposure to significant volumes of water. This daily exposure to water washes conventional antimicrobials from the surfaces to which they are applied, requiring frequent reapplication to retain a desired level of antimicrobial action. For the present invention, the addition of epoxy improves the surface chemistry of low surface energy surfaces such as polyolefins and enable antimicrobials to remain on a substrate for an extended period of time to make frequent reapplication unnecessary.

An antimicrobial additive can be incorporated in resin concentrate form into the amorphous zones of the molecular structure of the polymer from which containers are injection molded, thereby incorporating the antimicrobial agent into the container. The preferred method of associating the antimicrobial agent with a pallet is to incorporate the antimicrobial agent into a synthetic, polymeric master batch prior to forming the pallet body.

In the most basic form of the present invention, the pallet can include a broad spectrum antimicrobial agent associated therewith to inhibit bacterial, fungal, viral and other pathogen growth. The pallet can have a topdeck with an open deck design, a plurality or polymeric friction surfaces attached to the pallet, and an antimicrobial agent integrally associated with the pallet. Preferably, an antimicrobial agent is associated or incorporated into the polymeric material from which the pallet is made. Thus, an effective amount of an antimicrobial substance (e.g., 5-chloro-2-(2,4-dichlorophenoxy)phenol) is incorporated therein. Levels of active ingredients or antimicrobial substance range preferably from 1000 to 5000 parts per million (ppm) by weight. These levels can be substantially higher than would otherwise be required for antimicrobial efficacy in order to enhance migration from the pallet body into friction surfaces.

The pallet having the antimicrobial agent therein has enhanced resistance to growth of fungus, yeast, virus, and gram positive and gram negative bacteria including *S. aureus, E. coli, K. pneumoniae*, and *Salmonella*. The antimicrobial substance, which is non-toxic and free of heavy metal, may be a chlorinated phenol (e.g., 5-chloro-2-(2,4-dichlorophenoxy)phenol). An alternative antimicrobial agent is polyhexamethylene biguanide hydrochloride (PHMB). Other chemical compounds having known antimicrobial characteristics may also be used in the present invention.

In a preferred embodiment, 5-chloro-2-(2,4-dichlorophenoxy)phenol can be incorporated in resin-concentrated form into the amorphous zones of the polymers from which pallets can be injection-molded. Polymeric materials used for the friction material are preferably an ionomer, such as Surlyn™. More preferably, the friction material is Surlyn 1705. Surlyn used to form the friction is a difficult material to incorporate antimicrobial agents therein because of the high temperatures associated with producing and forming Surlyn and abrasive granules. In a preferred embodiment of the present invention, antimicrobial agents can be incorporated into the pallet body and migrate into the friction material. The antimicrobial agent incorporated into the pallet body is characterized in that the agent moves from areas of high concentrations of agent to low concentrations of agent. The antimicrobial additive chosen can be essentially insoluble in water which can prevent any leaching of the compound during use.

By controlling the amount of antimicrobial agent incorporated into the pallet body, migration of antimicrobial agent from the pallet body into the friction material is accomplished while maintaining the structural integrity of the pallet body. Surprisingly, even when different polymeric materials are used for the friction surfaces and pallet body, the selected antimicrobial agent migrates across the interface between the pallet body and the friction surface into the friction surface when incorporated using the method described herein. Incorporating an appropriate amount of antimicrobial agent into the pallet body is important. High concentrations of antimicrobial agent incorporated into the pallet can result in degradation of the physical properties of the polymer composing the pallet body. Low concentrations of antimicrobial agent incorporated into the pallet body minimize the migration of antimicrobial agent into the friction material. The appropriate concentration range of antimicrobial agent in the pallet body is carefully chosen to effectively provide nontoxic, antimicrobial protection to the pallet without sacrificing desirable physical properties of the polymer used to form the pallet body.

Incorporating antimicrobial agent into the polymer during manufacture of the pallet requires care because of the high temperatures and varying physical parameters involved. Organic antimicrobial agents typically have a vaporization point less than the temperatures involved during manufacture of the polymer. For example, 5-chloro-2-(2,4-dichlorophenoxy)phenol has a range of liquid phase from about 57° C. to about 74° C. and a vaporization point of about 204° C., whereas the temperatures associated with forming plastic are typically above 204° C. If antimicrobial agent was introduced into the polymer during manufacture, the agent typically vaporized and did not become incorporated into the polymer. Alternatively, the antimicrobial agent could crosslink with the polymer. Crosslinking of the antimicrobial agent with the polymer is undesirable because the physical properties of the polymer can be degraded. Furthermore, crosslinking prevents the migration of antimicrobial agent through the polymer of the pallet body and eventually into the friction surfaces through the interface of the pallet body. The antimicrobial agent in concentrate pellet form can be added as a component to the mixture comprising the synthetic polymeric material in a ratio which results in a final concentration of active ingredient of from about 0.005 parts to about 2.0 parts by weight. The active antimicrobial biocidal or biostatic agent preferably comprises from about 0.15 parts to about 0.25 parts by weight of the synthetic polymer into which the agent is incorporated. The semi-IPN formulation synergistically provides the ability to reduce temperatures during manufacture or production such that biocides can be incorporated into the plastic shipping container.

By combining antimicrobial agent pellets from a master batch production with other polymer pellets, the resulting polymer in the pallet body that is formed has a known concentration of antimicrobial agent. A range of from about 0.1 parts to about 0.5 parts by weight of antimicrobial agent in the resulting polymer is preferred. The preferable range of antimicrobial agent incorporated into the polymer is from about 0.15 parts to 0.25 parts by weight, based on the weight of the total composition. Because of the encapsulation of the antimicrobial agent in pellet form, the antimicrobial agent can survive the heating process and can be incorporated into the amorphous zones of the polymer. The characteristics of the antimicrobial agent allow the agent to migrate through the polymer to the surface of the pallet body from the amorphous zones until equilibrium of the agent's internal vapor pressure is reached. As the antimicrobial agent on the surface of the pallet is removed by friction or other means, more antimicrobial agent will move to the surface until the agent's internal vapor pressure is once again at equilibrium. Normally the antimicrobial agent melts at approximately 66° C., and loses its biocidal properties at high temperatures.

The present invention provides water-based coatable antimicrobial compositions that can be applied to a suitable plastic container to provide long lasting protection from the growth of any of a variety of microbes such as mold, mildew, algae, fungi, and the like. The antimicrobial compositions of the invention may be applied as a liquid over a plastic container and, upon drying, will form protective and adherent polymeric coatings which slowly release biocide to the surrounding substrate for extended periods of time. The polymeric coatings of the invention may be easily removed from the substrate (e.g., by alkaline washing) but are capable of remaining on the substrate even after exposure to significant and even continuous warm water rinsing for prolonged periods of time. The semi-IPN formulation synergistically provides the ability to increase surface energy such that biocides can be effectively coated onto plastic shipping containers.

Mildewcides are known in the art and are disclosed in U.S. Pat. No. 5,585,407, which is incorporated herein by reference.

It should be understood that the above described compositions and processes are not limiting. Modifications can be made to the formulation and process in various embodiments of the invention. While the present invention article can be described as a pallet, the present invention is not intended to be limited to pallets and may be applied to containers having diverse designs.

It should be understood that any of the above described embodiments may be suitably combined with one another. The present invention discloses the simultaneous incorporation, using inert gases, of thermosetting monomers into thermoplastics and their foaming. These monomers can be crosslinked at any point during processing or subsequently, to improve the properties of the foamed structure, with the thermoplastic acting as the continuous phase or matrix. We have found the use of thermally decomposable and organic physical blowing agents in some thermoplastic/thermoset systems to be advantageous. Other desirable effects or properties found are the reinforcement of the foam with crosslinked monomers, the increased miscibility of the monomer in the matrix, the microencapsulation effect observed and the increase surface compatibility with other foams, skin layers, adhesives, liners or substrates. These thermoplastic/thermoset foams can be advantageous in the cured and uncured state.

Objects and advantages of this invention are further illustrated by the following examples, but the particular materials and amounts thereof recited in these examples, as well as other conditions and details, should not be construed to unduly limit this invention.

Effect of Epoxy Component on Shear Viscosity—Shear Rate Behavior

Rheological data shown below in Table 1 were acquired using an Instron capillary rheometer (Instron Corp., Canton, Mass.) to demonstrate the influence of uncured epoxy on the viscosity. The capillary had a length of 2.032 centimeters and a diameter of 0.055 centimeter with a die aspect ratio L/D of 37. The experiment was conducted at 195° C. at to speeds ranging from 0.127 centimeter per minute to 20.32 centimeters per minute. The data were corrected using Rabinowitsch correction factor to account for the velocity gradient at the die wall for non-Newtonian fluids. A die entrance effect (Bagley correction) was not done. This effect was negligible due to the long die aspect ratio.

TABLE 1

Shear Rate - Shear Viscosity Data

| Sample | Shear Rate ($s^{-1}$) | Shear Viscosity ($Kg\ m^{-1}\ s^{-1}$)) |
|---|---|---|
| PP1 (100%) | 63.775 | 1278.2 |
| | 159.44 | 517.24 |
| | 318.87 | 308.9 |
| | 637.75 | 191.24 |
| | 1594.4 | 103.46 |
| | 3188.7 | 63.136 |
| | 6377.5 | 37.4482 |
| | 12755 | 22.599 |
| | 25510 | 13.93 |
| PP1 (90%)/Epoxy (10%) | 54.595 | 946.64 |
| | 136.49 | 343.5 |
| | 272.97 | 210.7 |
| | 545.95 | 152.95 |
| | 1364.9 | 92.463 |
| | 2729.7 | 64.677 |

TABLE 1-continued

Shear Rate - Shear Viscosity Data

| Sample | Shear Rate ($s^{-1}$) | Shear Viscosity (Kg $m^{-1}$ $s^{-1}$)) |
|---|---|---|
| | 5459.5 | 41.083 |
| | 10919 | 24.924 |
| | 21838 | 14.777 |

Table 1 shows that in the 100–1000 $s^{-1}$ shear rate region, which is normally encountered during extrusion compounding of thermoplastics, addition of epoxy reduced the shear viscosity of the polyolefin (PP1). Thus one of the processing advantages of the present pallet formulations was the decrease in viscosity during compounding in standard mixing equipment such as screw extruders. The viscosity reduction enabled additives such as flame-retardants, fillers, blowing agents, etc to be added at reduced temperatures, which can reduce both material processing and energy costs.

Process for Injection Molding of Curable Polymeric Compositions

An injection molding machine (Engel, Guelph, Ontario, Canada) was utilized to make plate, bar, and disk specimens for mechanical property measurements. The injection molding machine included a 136 metric tons press (molding machine) with a 30-mm injection unit along with Sterlco (Sterling, Inc., Milwaukee, Wis.) mold temperature controllers and a multi-cavity mold. The mold had a cold runner melt delivery system. Standard processing conditions were used for all samples. Average melt temperature was set at 199° C., while barrel temperature set-points were 199° C., 199° C., 199° C., and 177° C. at the rear zone. Shot size was set at 57.9 mms. Injection velocity was set at 100 millimeters per second with switch over to hold by position at 8 millimeters. The resultant fill pressure was recorded at $3.31\times10^6$ kilogram per meter per second, hydraulic pressure. Hold pressure (hydraulic) was set at $1.38\times10^6$ kilogram per meter per second. Hold time was set for 3.0 seconds with a 30-second mold cooling time. Elapsed fill time was recorded at 0.61 seconds. Backpressure was set at $3.45\times10^5$ kilogram per meter per second with screw speed set at 40 percent of system speed. Screw recovery time average was 15.6 seconds. Total cycle time was recorded at 41.5 seconds.

EXAMPLES

Examples 1–7 and Comparative Examples C1 and C2

Formulation of Curable Polymeric Compositions

Curable polymeric compositions for pallets and containers were compounded in a 33-mm co-rotating twin-screw extruder (Sterling Extruder Corporation, Plainfield, N.J.) using the components and amounts (in parts by weight) shown in Table 2. The extruder had a length to diameter (L/D) ratio of 24:1, multiple feeding ports, and was capable of compounding plastics/additives in the form of pellets and powders and output either as film strands or pellets in a single pass. Two volumetric feeders (Accurate Dry Materials Feeders, Whitewater, Wis.) were used to feed the additives into the extruder. Liquids such as uncured epoxy liquid were fed separately via a variable speed pump (Zenith Pumps, Sanford, N.C.). The compounding temperature range from hopper to die was 50° C. to 200° C. Screw speed was 250 revolutions per minute. Die output rate was 5897 grams per hour. The extrudate coming out from the die was pelletized and dried for several days at room temperature.

TABLE 2

Polymeric Compositions

| Example* | PP1 | PP2 | Epoxy | FR | Filler | MPP | BA |
|---|---|---|---|---|---|---|---|
| 1 | 73.1 | 0 | 12.9 | 14 | 0 | 0 | 0 |
| 2 | 0 | 73.1 | 12.9 | 14 | 0 | 0 | 0 |
| 3 | 62.9 | 0 | 11.1 | 14 | 10 | 2 | 0 |
| 4 | 0 | 62.9 | 11.1 | 14 | 10 | 2 | 0 |
| 5 (Low) | 71.4 | 0 | 12.6 | 14 | 0 | 0 | 2 |
| 6 (High) | 71.4 | 0 | 12.6 | 14 | 0 | 0 | 2 |
| 7 | 73.1 | 0 | 12.9 | 14 | 0 | 0 | 0 |
| C1 | 100 | 0 | 0 | 0 | 0 | 0 | 0 |
| C2 | 0 | 100 | 0 | 0 | 0 | 0 | 0 |

Table 2 above shows typical plastic container compositions in parts by weight. Detail material information is given below:

PP1 (in pellet form): propylene-ethylene random copolymer having low ethylene content (available as ESCORENE™ PP7033N from ExxonMobil Chemical, Houston, Tex.)

PP2 (in pellet form): propylene-ethylene random copolymer having high ethylene content (available as ESCORENE™ PP7032N from ExxonMobil Chemical, Houston, Tex.)

Epoxy (in liquid form): Uncured diglycidyl ether of bisphenol-A (available as EPON™ 828 from Shell Chemicals, Houston, Tex.)

FR (in powder form): nitrogen/phosphorus-based flame retardant (available as EXOLIT™ AP750 from Clariant, Charlotte, N.C.)

MPP (in pellet form): malleated polypropylene (available as EPOLENE™ G3003 from Eastman Chemicals, Kingsport, Tenn.)

Filler (in powder form): mica (aluminosilicate) having an average particle size of 5 micrometers (available from Micro-Lite, Inc., Chanute, Kans.)

BA (in pellet form): azo dicarbonamide blowing agent in polyethylene base (30 wt % percent), available from Ampacet, Cincinnati, Ohio.

Low: Activation of blowing agent (BA) at low temperature (200° C.)

High: Activation of BA at high temperature (220° C.)

Examples 8–14 and Comparative Examples C3 and C4

Thermal Expansion and Contraction Evaluations

Molded specimens were made according to the injection molding process above using the compositions in Table 2 and evaluated for thermal expansion and contraction according to ASTM Standard Test Method E831-93 for linear thermal expansion and contraction using a thermo mechanical analyzer (Perkin Elmer Corporation, Norwalk, Conn.). For the expansion evaluations, specimens were heated at 10° C. per minute from −50° C. to 100° C. For the contraction evaluations the samples were cooled at 10° C. per minute from 100° C. to −50° C. The applied force was $50\times10^{-3}$ kilogram per meter per second while Helium gas was used as the purge gas. For each formulation, five samples were evaluated to obtain average expansion coefficient/total expansion and average contraction coefficient/total contraction data. The results are shown in Table 3.

TABLE 3

Thermal Expansion/Contraction Behavior of Molded Compositions

| Example | 8 | 9 | 10 | 11 | 12 | 13 | 14 | C3 | C4 |
|---|---|---|---|---|---|---|---|---|---|
| Composition Example | 1 | 2 | 3 | 4 | 5 (Low) | 6 (High) | 7 | C1 | C2 |
| Expansion Coefficient ($\times 10^{-6}$/° C.) | 99.8 | 102.0 | 111.4 | 113.9 | 110.6 | 106.3 | 116.3 | 152.5 | 150.0 |
| Contraction Coefficient ($\times 10^{-6}$/° C.) | 115.2 | 120.9 | 110.8 | 111.2 | 120.8 | 121.3 | 121.2 | 154.8 | 153.3 |
| % Total Expansion | 1.5 | 1.5 | 1.7 | 1.7 | 1.7 | 1.6 | 1.7 | 2.3 | 2.2 |
| % Total Contraction | 1.7 | 1.8 | 1.6 | 1.7 | 1.8 | 1.8 | 1.8 | 2.3 | 2.3 |

As the data of Table 3 show, the compositions of Examples 8–14 (the compositions of Examples 1–6) had lower values for both expansion and contractions relative to Comparative Examples C3 and C4 (Comparative Examples C1 and C2 (polyolefins alone)). In some compositions such as Examples 3 and 4, the difference between expansion and contraction values was almost zero. The benefit of the reduced thermal expansion/contraction was that stability in automated injection molding equipment was ensured. Also, dimensional integrity of any container or pallet made from these compositions can be maintained.

Flexural Moduli Evaluations

Injection-molded bars (12.7 centimeters long by 1.27 centimeters wide by 0.635 centimeter thick) made as described above were evaluated for flexural moduli using ASTM D 790-89 Test Method I (three-point loading system utilizing center loading on a simply supported beam). For the evaluation, a Sintec 20 Computerized Testing Machine (MTS Corporation, Eden Prairie, Minn.) was used. The load cell used was 45.26 kilograms, while the crosshead speed was 0.279 centimeters per minute. The resulting flexural modulus data is shown in Table 4.

TABLE 4

Flexural Modulus of Molded Compositions

| Example | 8 | 9 | 10 | 11 | 14 | C3 | C4 |
|---|---|---|---|---|---|---|---|
| Composition Example | 1 | 2 | 3 | 4 | 7 | C1 | C2 |
| Flexural Modulus (MPa) | 1.66 | 1.62 | 2.09 | 2.10 | 1.73 | 1.42 | 1.06 |

The data of Table 4 show the average flexural moduli obtained. The results show that the presence of cured epoxy, flame retardant, and filler, enhanced the flexural strength of the molded specimens of Examples 8–14 (made from compositions of Examples 1–7) relative to Comparative Examples C3 and C4 (made from compositions of Comparative Examples C1 and C2 with polyolefins only). Samples of Examples 12 and 13 (made from composition Examples 5 (Low) and 6 (High)) were not evaluated for flexural modulus.

Izod and Falling Dart Impact Strength Evaluations

Injection molded bars made as described above were evaluated for Izod and falling dart impact strength. The Izod impact test was performed by Aspen Research Corporation, White Bear Lake, Minn. Samples were notched according to ASTM D256 by Aspen Research Corporation. Prior to evaluation, notched samples were conditioned for 40 hours at 23° C. and 59% relative humidity according to the test method. Samples were ran on the lowest pendulum scale, which was equal to 0.2883 meters kilogram full scale. For the falling dart impact evaluation, the reference test methods were ASTM D5628-96 and D3763-99. The test was done using Dynatup Impact Testing Systems (Dynatup General Research Corporation, Santa Barbara, Calif.). The load used was 27.7 kilograms, while the Tup diameter was 0.127 centimeters. The samples were in the form injection-molded plates of dimension 10.16 centimeters long by 10.16 centimeters wide by 0.64 centimeter thick. The resulting impact strength data is shown in Table 5.

Table 5. Notched Izod Impact Strength and Falling Dart Impact Strength of Molded

| Example | 8 | 9 | 10 | 11 | 14 | C3 | C4 |
|---|---|---|---|---|---|---|---|
| | Compositions | | | | | | |
| Composition Example | 1 | 2 | 3 | 4 | 7 | C1 | C2 |
| Notched Izod Impact Strengh (J/m) | 35.8 | 46.8 | 52.3 | 71.8 | 36.6 | 87.0 | 145.7 |
| Falling Dart Impact Strength (J) | 48.2 | 47.6 | 44.2 | 56.2 | 47.4 | 87.8 | 88.4 |

The average impact strengths shown in Table 5 confirmed that the impact strengths of Examples 8–14 (made from compositions of Examples 1–7) were below those of Comparative Examples C3 and C4 (made from composition Comparative Examples C1 and C2 with polyolefins only), which was in agreement with the flexural modulus results on Table 4. Typically, when flexural modulus is higher, it is expected that impact strength is lower. The impact strengths of Examples 8–14 were acceptable, and modification in the blend ratios was expected to increase impact strengths. Samples of Examples 12 and 13 (made from composition Examples 5 (Low) and 6 (High)) were not evaluated for impact strength.

Fire Resistance Evaluations

For the evaluation, ASTM Standard Test Method E1354-97 was followed for heat and visible smoke release for materials and products using an oxygen consumption calorimeter known commonly as cone calorimeter. The heat and visible smoke release were useful parameters for the assessment of fire hazards. The procedures followed were as described in the test method. For each molded composition prepared as described above, five different samples, each of dimension 10.16 centimeters long by 10.16 centimeters wide by 0.64 centimeter thick, were evaluated. The specimen orientation was horizontal with spark igniter using $35\times10^3$ Watt per square meter exposure. The resulting fire resistance evaluation data is shown in Table 6.

TABLE 6

Results of Fire Resistance Evaluation of Molded Compositions

| Example | Ignition Time (sec) | Flame Duration (sec) | Initial Mass (grams) | Total Mass Loss (grams) | % Mass Loss | Peak Heat Release Rate ($kW/m^2$) | Time of Peak Heat Release | Average Heat Release Rate @ 180 sec ($kW/m^2$) | Total Heat Released ($MJ/m^2$) | Average Heat of Combustion (MJ/kg) |
|---|---|---|---|---|---|---|---|---|---|---|
| 8 | 24 | 2203 | 68 | 57 | 83 | 238 | 314 | 102 | 297 | 51.7 |
| 9 | 26 | 1817 | 68 | 56 | 82 | 245 | 365 | 108 | 263 | 47.0 |
| 10 | 29 | 1330 | 70 | 59 | 84 | 335 | 202 | 264 | 270 | 45.5 |
| 11 | 30 | 1093 | 69 | 58 | 84 | 378 | 167 | 315 | 271 | 46.4 |
| 14 | 23 | 2691 | 67 | 55 | 83 | 249 | 467 | 117 | 420 | 76.3 |
| C3 | 54 | 389 | 41 | 41 | 69 | 635 | 219 | 340 | 146 | 35.6 |
| C4 | 52 | 449 | 59 | 50 | 86 | 826 | 314 | 328 | 192 | 38.3 |

The data of Table 6 show that Examples 8, 9, 10, 11, and 14 (made from compositions of Examples 1, 2, 3, 4, and 7 performed best in reducing the hazard in a fire situation when compared to Comparative Examples C3 and C4 (made from compositions of Comparative Examples C1 and C2 with polyolefins only) because the heat release rate was a direct measure of the intensity of the fire. These results indicated that a container made with these compositions would pass the UL 2335 protocol. Samples of Examples 12 and 13 (made from compositions of Examples 5 (Low) and 6 (High)) were not available for fire resistance testing.

Tensile Property Evaluations

Molded compositions prepared as described above were made into a standard dumbbell shape with the dimensions of 3.81 centimeter long by 1.59 centimeters wide at end by 0.48 centimeter wide at center by 0.32 centimeter thick. The tensile moduli were determined following ASTM Test Method D 638-99. For the evaluations, an Instron Corporation (Canton, Mass.) Series X Automated Testing System was used with a crosshead speed of 5.08 centimeter per minute at 23° C. and 41% relative humidity. For each molded composition, five samples were evaluated to obtain an average modulus. The results are shown in Table 7.

TABLE 7

Tensile Moduli of Molded Compositions

| Example | 8 | 9 | 10 | 11 | 12 | 13 | 14 | C3 | C4 |
|---|---|---|---|---|---|---|---|---|---|
| Composition Example | 1 | 2 | 3 | 4 | 5 (Low) | 6 (High) | 7 | C1 | C2 |
| Tensile Modulus (MPa) | 1156.9 | 1273.7 | 1506.4 | 1372.5 | 1080.2 | 987.4 | 1184.6 | 1136.7 | 931.9 |

The data show that higher modulus was obtained for Examples 8–14 (made from compositions of Examples 1–7) relative to Comparative Examples C3 and C4 (made from compositions of Comparative Examples C1 and C2 with polyolefin only).

Overlap Shear Strength Evaluations

The surface properties of the molded container compositions with respect to heat and adhesives bonding was evaluated by determining overlap shear strengths. For both bonding tests, molded bars 12.7 centimeters long by 1.27 centimeters wide by 0.32 centimeter thick, prepared as described above were used. Prior to bonding, the surfaces of the bars were cleaned by rubbing with a piece of dry cloth. Pairs of samples were heat-bonded at 200° C. using a hot plate, or they were adhesive-bonded using CA-4 Cyanoacrylate Adhesive (available from 3M, St. Paul, Minn.). A bond area 2.54 cm long and 1.27 cm wide was made for each sample. Holding the bonded samples under pressure for at least a day prior to overlap shear measurement ensured uniform and firm bonds. Samples were evaluated with Instron Corporation (Canton, Mass.) Series X Automated Testing System. A total of five samples were evaluated to obtain an average value of overlap shear strength for each composition. The results are shown in Table 8.

TABLE 8

Overlap Shear Strengths (Adhesive and Heat Bonding) of Molded Compositions

| Example | 8 | 9 | 10 | 11 | 12 | 13 | 14 | C3 | C4 |
|---|---|---|---|---|---|---|---|---|---|
| Composition Example | 1 | 2 | 3 | 4 | 5 (Low) | 6 (High) | 7 | C1 | C2 |
| Heat Bonding (MPa) | 1.92 | 1.87 | 1.99 | 2.31 | 1.74 | 1.77 | 2.06 | 2.61 | 2.4 |
| Adhesive Bonding (MPa) | 1.25 | 1.36 | 0.47 | 0.47 | 0.4 | 0.33 | 1.33 | 0.17 | 0.42 |

The data of Table 8 show that adhesive bond strengths comparable to heat bond strengths were obtained for Examples 8, 9, and 14. This suggested that standard adhesives can be used to adhere identification and tracking labels to containers as well as for bonding container components together when using the molded composition of the present invention.

Examples 15–19 and Comparative Examples C5 and C6

Coefficient of Static Friction Determination

Friction surfaces were desired on pallets because loads can fall off pallets, stacks of pallets can tip over, and pallets can fall off fork trucks without sufficient friction on their surfaces. The coefficient of static friction values of several friction materials useful in the present invention were determined as well as those of comparative polypropylene in film form and a pine wood pallet. The film was prepared by extruding Comparative Example C1 composition into a 0.36 mm thick film form. The wood pallet was a commonly available pallet. The friction material (anti-slip film) was inserted into the mold and then the curable polymeric composition containing epoxy of Example 1 was injected into the mold as described above. This process of sequentially adding the friction material during the injection molding process was an in-mold lamination process. The reduced viscosity provided by the epoxy-containing composition aided in the process of laminating the friction material by a) minimizing the chance that the friction material would shift during the injection molding process, and b) by minimizing the tendency of the friction particles to become imbedded into the substrate, which would reduce the effectiveness of the friction material. The friction material evaluated for Example 15 was prepared in the same manner as Example 2 in U.S. Pat. No. 6,258,201. Aluminum oxide particles with an average particle size of 400 micrometers (ANSI Grade 46) were passed through a thermal sprayer and embedded into a 0.356 mm thick Surlyn extruded film. The friction material evaluated for Example 16 was prepared in the same manner as Example 2 in U.S. Pat. No. 6,258,201 except that 400 micrometer particle size quartz particles (50 mesh obtained from US Silica Company, Berkely Springs, W. Va.) were embedded in the Surlyn film. The friction material for Example 17 was also prepared in the same manner as Example 2 in U.S. Pat. No. 6,258,201 except that 1000 micrometer particle size ceramic spheres (Carbo Prop™ 20/40, obtained from Carbo Ceramics, Irving, Tex.) were embedded into the Surlyn film.

The friction material evaluated for Example 18 was prepared by microreplicating a thermoplastic rubber sheet with cylindrical stems that had a stem density of 50 stems per square centimeter, a substrate thickness of 0.127 mm, a stem height of approximately 0.94 mm, a stem diameter of 0.44 mm, and a stem spacing of 1.4 mm. The friction material consisted of the resulting stem layer material (described in WO 9732805, but with none of the mechanical fastener layers were formed). The stem layer material was formed from impact copolymer resin available from Shell Polypropylene Company, Houston, Tex. under the designation SRD7-560™.

The friction material evaluated for Example 19 was prepared by microreplicating a 0.356 mm thick Surlyn sheet with a pyramidal shape (made according to U.S. Pat. No. 5,897,930 and U.S. Pat. No. 5,152,917). In particular, Surlyn was extruded onto an array outlined in FIG. 18 of U.S. Pat. No. 5,152,917.

Coefficient of static friction values were determined under wet, dry, and oily conditions. The oil used was vegetable oil.

The following friction materials were evaluated: in Example 15, 0.356 mm thick Surlyn film coated with 400 micrometer average diameter aluminum oxide particles (made according to U.S. Pat. No. 6,258,201); in Example 16, 0.356 mm thick Suryln film coated with 400 micrometer average diameter quartz particles (made according to U.S. Pat. No. 6,248,201); in Example 17, 0.356 mm thick Surlyn film coated with 1000 micrometer average diameter ceramic spheres (made according to U.S. Pat. No. 6,258,201); in Example 18, 1.02 mm thermoplastic rubber sheet with microreplicated surface of cylindrical shape (made according to WO 9732805); and in Example 19, 0.356 mm thick Surlyn microreplicated surface of pyramidal shape (made according to U.S. Pat. No. 5,897,930 and U.S. Pat. No. 5,152,917). The aforementioned patents are incorporated herein by reference. Coefficient of static friction values were determined under wet, dry, and oily conditions. The test method used was ASTM C1028-89. The equipment used was ASM 725 American Slip Meter (available from American Slip Meter, Inc., Englewoods, Fla.) with NEOLITE™ (synthetic rubber soling available as CROWN NEOLITE from Goodyear Tire & Rubber Co.) pads. This was a horizontal drag meter type, which measured the horizontal force when the unit was moved across the surface of the sample. The results are shown in Table 9.

TABLE 9

Coefficients of Static Friction of Surfaces for Shipping and Storage Containers

| | | ASM 725 American Slip Meter-Neolite Pads | | |
|---|---|---|---|---|
| Example | Material | Dry | Wet | Oil |
| C5 | Polypropylene* | 0.56 | 0.57 | 0.22 |
| C6 | Wood (rough pine) | 0.91 | 0.82 | 0.78 |

TABLE 9-continued

| Coefficients of Static Friction of Surfaces for Shipping and Storage Containers | | | | |
|---|---|---|---|---|
| | | ASM 725 American Slip Meter-Neolite Pads | | |
| Example | Material | Dry | Wet | Oil |
| 15 | Aluminum Oxide | 0.90 | 0.94 | 0.95 |
| 16 | Quartz | 0.90 | 0.91 | 0.63 |
| 17 | Ceramic spheres | 0.84 | 0.81 | 0.51 |
| 18 | Microreplicated thermoplastic rubber with cylindrical shape | 0.90 | 0.75 | 0.18 |
| 19 | Microreplicated Surlyn with pyramidal shape | 0.80 | 0.71 | 0.61 |

*polypropylene was representative of commodity plastic surfaces including polyolefins The data in Table 9 show that the coefficient of friction was tailorable such that a shipping container having these surfaces was not so abrasive that it abraded or damaged the contents on or in the shipping container. For example, aluminum oxide was more abrasive than quartz, which was more abrasive than ceramic spheres. Blends of particle size, shape, durability, and abrasiveness were useful. It should be noted that it was preferred to have the friction material compatible with recycling, including materials compatibility and equipment capability (i.e. does not damage the equipment via abrasive action). It is a preferred embodiment that the particles are of such size (typically greater than 100 micrometers and up to 5000 micrometers or even larger) that they can be readily captured upstream (for example, by filtration during recycling) in the process sequence to prevent damage to barrels, screws, dies, and or tooling, and prevent contamination of the recycled composition, which could cause a loss in strength or durability.

These materials and methods can be used by those skilled in the art to make containers and pallets using conventional plastic shaping procedures such as injection molding, extrusion, thermoforming, blow molding, rotational molding, and the like.

Various modifications and alterations of this invention will become apparent to those skilled in the art without departing from the scope and intent of this invention, and it should be understood that this invention is not to be unduly limited to the illustrative embodiments set forth herein.

It is claimed:

1. A method for producing a flame retardant-containing plastic shipping or storage container or one or more shaped parts thereof comprising the steps:

a) admixing a composition comprising (1) one or more thermosetting resins and one or more curing agents therefore, (2) a fully pre-polymerized uncrosslinked hydrocarbon polyolefin resin, and optionally a fully pre-polymerized uncrosslinked functionalized polyolefin, and b) exposing said composition to curing conditions after forming the composition into a shipping or storage container or one or more shaped parts thereof, said shaped parts subsequently being secured together to form said shipping or storage container, wherein said polymeric composition comprises 1 to 49 parts by weight of said curable thermosetting resin, the parts by weight being based on the total composition, and 51 to 99 parts by weight of a combination of at least one of said fully prepolymerized uncrosslinked hydrocarbon polyolefin resin and said fully prepolymerized uncrosslinked functionalized polyolefin resin, the parts by weight being based on the total composition, wherein said hydrocarbon polyolefin is present in the range of 25 to 99 parts by weight of the total composition and said functionalized polyolefin is present in the range of 0 to 50 parts by weight of the total composition, and wherein said plastic container composition contains a flame retardant, said flame retardant being selected from the group consisting of non-halogenated flame retardants.

2. The method according to claim 1 wherein said composition comprises a foamed structure.

3. The method according to claim 1 wherein said plastic container further comprises one or more of performance enhancement additives selected from the group consisting of antimicrobial additives, mildewcides, foaming agens, fillers, and friction material on at least one surface thereof.

4. The method according to claim 3 wherein said performance enhancement additives are present in the range of more than 0 and up to 70 parts by weight of the weight of the total composition.

5. The method according to claim 3 wherein said plastic container comprises one or both of bubbles and glass beads as fillers.

6. The method according to claim 1 wherein said uncrosslinked prepolymerized polyolefin resin is selected from the group consisting of homopolymers, copolymers, blends with other polyolefins, blends with high impact polymers and blends with rubbers or elastomers.

7. The method according to claim 1 wherein said plastic container is a pallet.

8. The method according to claim 1 wherein said thermosetting resin is selected from the group consisting of epoxies, curable polyolefins, ethylene propylene rubber, ethylene butylene rubber, phenolics, polyurethanes, unsaturated polyesters, furan, allyls, vinyls, silicones, alkyds, nitrile rubber, mid functionalized rubber.

9. The method according to claim 1 wherein said thermosetting resin is an epoxy resin.

10. The method according to claim 1 wherein polyolefin resin is selected from the group consisting of alpha-olefins, copolymers of said alpha-olefins, and functionalized polyolefins wherein the functionalized groups include one or more of O, N, S, and P atoms.

11. The method according to claim 1 wherein said flame retardant is selected from the group consisting of ammonium phosphates, compounds containing phosphorus-nitrogen bonds, and cyclic phosphates.

12. The method according to claim 1 wherein said flame retardant in said composition is present in the range of more than 0 and up to 70 parts by weight of the total weight of the polymeric composition.

13. The method according to claim 12 wherein said flame retardant in said composition is present in the range of more than zero and up to and including 25 parts by weight of the total polymeric composition.

14. The method according to claim 1 wherein the resulting cured composition comprises an interpenetrating polymer network.

15. The method according to claim 1 wherein said plastic container further comprises friction material on at least one surface thereof.

16. The method according to claim 15 wherein said friction material adheres to said surface without the addition of an adhesive.

17. A method comprising the steps of a) providing a molten mixture comprising a curable epoxy resin, a curative for the curable epoxy resin, said curative being stable at temperature of mixing, and at least one of a fully prepolymerized uncrosslinked hydrocarbon polyolefin resin and optionally a fully prepolymerized uncrosslinked functionalized polyolefin resin, and wherein said molten mixture contains a flame retardant said flame retardant being selected from the group consisting of non-halogenated flame retardants, b) applying the mixture to a mold, and c) at any subsequent time, activating the curative to produce a semi-interpenetrating polymer network, wherein said application of said molten mixture to said mold is preceded by in-mold application of friction material.

18. The method according to claim 17 wherein said molten mixture further comprises one or more performance enhancement additives selected from the group consisting of antimicrobials, mildewcides, foaming agents, and fillers.

19. A method for producing a flame retardant-containing plastic shipping or storage container or one or more shaped parts thereof comprising the steps:

a) admixing a composition comprising (1) one or more thermosetting resins and one or more curing agents therefore, (2) a fully pre-polymerized uncrosslinked hydrocarbon polyolefin resin, and optionally a fully pre-polymerized uncrosslinked functionalized polyolefin, and b) exposing said composition to curing conditions after forming the composition into a shipping or storage container or one or more shaped parts thereof, said shaped parts subsequently being secured together to form said plastic shipping or storage container, wherein said plastic container composition contains a flame retardant, said flame retardant being selected from the group consisting of non-halogenated flame retardants, and wherein said plastic container further comprises one or more of radio frequency identification (RFID)-tags.

20. A method for producing a flame retardant-containing plastic pallet or one or more shaped parts thereof comprising the steps:

a) admixing a composition comprising 1) 1 to 49 parts by weight of one or more thermosetting resins and one or more curing agents therefore, the parts by weight being based on the total composition, and 2) 51 to 99 parts by weight of a combination of at least one of a fully pre-polymerized uncrosslinked hydrocarbon polyolefin resin and optionally a fully pre-polymerized uncrosslinked functionalized polyolefin resin, the parts by weight being based on the total composition, wherein said hydrocarbon polyolefin is present in the range of 25 to 99 parts by weight of the total composition and said functionalized polyolefin is present in the range of 0 to 50 parts by weight of the total composition, and b) exposing said composition to curing conditions after forming the composition into a plastic pallet or one or more shaped parts thereof, wherein said plastic pallet or one or more shaped parts thereof contains a flame retardant, said flame retardant being selected from the group consisting of non-halogenated flame retardants.

21. The method according to claim 20 further comprising the step of securing together said shaped parts to produce said flame retardant-containing plastic pallet.

* * * * *

UNITED STATES PATENT AND TRADEMARK OFFICE

CERTIFICATE OF CORRECTION

PATENT NO. : 7,216,592 B2
APPLICATION NO. : 10/672581
DATED : May 15, 2007
INVENTOR(S) : John E. Krech It is certified that error appears in the above-identified patent and that said Letters Patent is hereby corrected as shown below:

Title Page
(73) Assignee, Delete "3m" and insert -- 3M --, therefor.

Column 3
Line 34, Delete "thereof," and insert -- thereof; --, therefor.

Column 13
Line 13, Delete "the–polymeric" and insert -- the polymeric --, therefor.
Line 33, Delete "incorportated" and insert -- incorporated --, therefor.

Column 16
Line 42, After "at" delete "to".
Line 54, Delete "(Kg $m^{-1}s^{-1}$))" and insert -- (Kg $m^{-1}s^{-1}$) --, therefor.

Column 17
Line 6, Delete "(Kg $m^{-1}s^{-1}$))" and insert -- (Kg $m^{-1}s^{-1}$) --, therefor.

Column 18
Line 46, After "(220° C,)" insert -- Curing agent for the epoxy was radiation-activated triarylsulfonium hexafluoroantimonate salt (available as SarCat™" SR1010 from Sartomer Company, Exton, PA), except for Example 7 where the curing agent was heat-activated dicyandiamide (DiCy™, available from Air Products and Chemicals, Allentown, PA) --.

Column 20
Line 45, Delete "Strengh" and insert -- Strength --, therefor.

Column 24
Line 38, Delete "6,248,201);" and insert -- 6,258,201); --, therefor.

Column 26
Line 24, In Claim 3, delete "agens," and insert -- agents, --, therefor.
Line 45, In Claim 8, delete "mid" and insert -- and --, therefor.

Column 27
Line 15, In Claim 17, delete "retardant" and insert -- retardant, --, therefor.

UNITED STATES PATENT AND TRADEMARK OFFICE

CERTIFICATE OF CORRECTION

PATENT NO. : 7,216,592 B2
APPLICATION NO. : 10/672581
DATED : May 15, 2007
INVENTOR(S) : John E. Krech It is certified that error appears in the above-identified patent and that said Letters Patent is hereby corrected as shown below:

Column 28
Line 8, In Claim 19, delete "(RFID)–tags." and insert -- (RFID) tags. --, therefor.

Signed and Sealed this

Thirtieth Day of October, 2007

JON W. DUDAS
*Director of the United States Patent and Trademark Office*